US006533590B1

(12) United States Patent
Lee et al.

(10) Patent No.: US 6,533,590 B1
(45) Date of Patent: Mar. 18, 2003

(54) BALL GRID ARRAY CONNECTOR HAVING IMPROVED CONTACT CONFIGURATION

(75) Inventors: Genn-Sheng Lee, Tu-Chen (TW); Ming-Lun Szu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/023,615

(22) Filed: Dec. 17, 2001

(51) Int. Cl.[7] ..... H01R 4/02
(52) U.S. Cl. ..... 439/83; 439/875; 439/876
(58) Field of Search ..... 439/83, 78, 876, 439/875, 342, 362

(56) References Cited

U.S. PATENT DOCUMENTS 6,056,558 A * 5/2000 Lin et al. ..... 439/83
6,217,348 B1 * 4/2001 Lin et al. ..... 439/83
6,303,993 B1 * 10/2001 Wark ..... 257/737
6,352,437 B1 * 3/2002 Tate ..... 439/83

* cited by examiner

*Primary Examiner*—P. Austin Bradley
*Assistant Examiner*—Alex Gilman
(74) *Attorney, Agent, or Firm*—Wei Te Chung

(57) ABSTRACT

An electrical socket for electrically connecting with a pin of a IC package. A contact secured in the socket comprises first and second claw portions formed on opposite ends thereof and two spring arms between the first and second claw portions for being engaged with the IC package pin. The first and second claw portions have two claw feet, respectively. The four claw feet define a clip section in which a solder ball can be received and kept in a predetermined plane when the solder ball is pressed towards the contact. The claw feet can grip the solder ball firmly to avoid the falling of the solder ball during assembling and soldering procedure.

6 Claims, 7 Drawing Sheets

BALL GRID ARRAY CONNECTOR HAVING IMPROVED CONTACT CONFIGURATION

BACKGROUND OF THE INVENTION

1. Field of the Invention

The present invention relates to a ball grid array connector, especially to a ball grid array socket (BGA) having positioning structures on electrical contacts thereof for retaining corresponding solder balls in position.

2. Description of the Related Art

As shown in FIG. 10, for a conventional BGA socket, solder balls 71 can be mechanically pressed in clip sections 72 formed in contacts 7, and then the connector can be soldered to the PCB. However, the engagement between the solder ball 71 and the clip section 72 is not firm especially when the solder ball 71 is occasionally formed as a small one and the clip section 72 is a large one. This unsecured engagement can result in the falling of the solder balls 71 when the socket is under an undesired shocking and even when the socket is being soldered to the PCB. Hence, a socket which can assure firm engagement between the solder ball and the clip section is desired.

Accordingly, an improved BGA socket is required to overcome the above disadvantage of conventional BGA sockets.

SUMMARY OF THE INVENTION

An object of the present invention is to provide a contact for a ZIF socket having a claw foot defined thereon for gripping the solder ball securely after the solder ball is pressed in the clip section, whereby the solder ball can be firmly engaged with the contact during assembly.

In order to achieve the object set forth, a ZIF socket for electrically connecting with pins of a IC package in accordance with the present invention comprising a plurality of contacts, the contact comprises first and second claw portions formed on opposite ends thereof and two spring arms between the first and second claw portions for being engaged with a pin of a IC package. The first and second claw portions have two claw feet defined thereon respectively, furthermore the four claw feet define a clip section in which a solder ball can be received and kept in a predetermined plane when the solder ball is pressed towards the contact, and simultaneously the claw feet can grip the solder ball firmly to avoid the falling of the solder ball during the assembly and solder procedure.

DESCRIPTION OF THE PREFERRED EMBODIMENT

Figure 1:
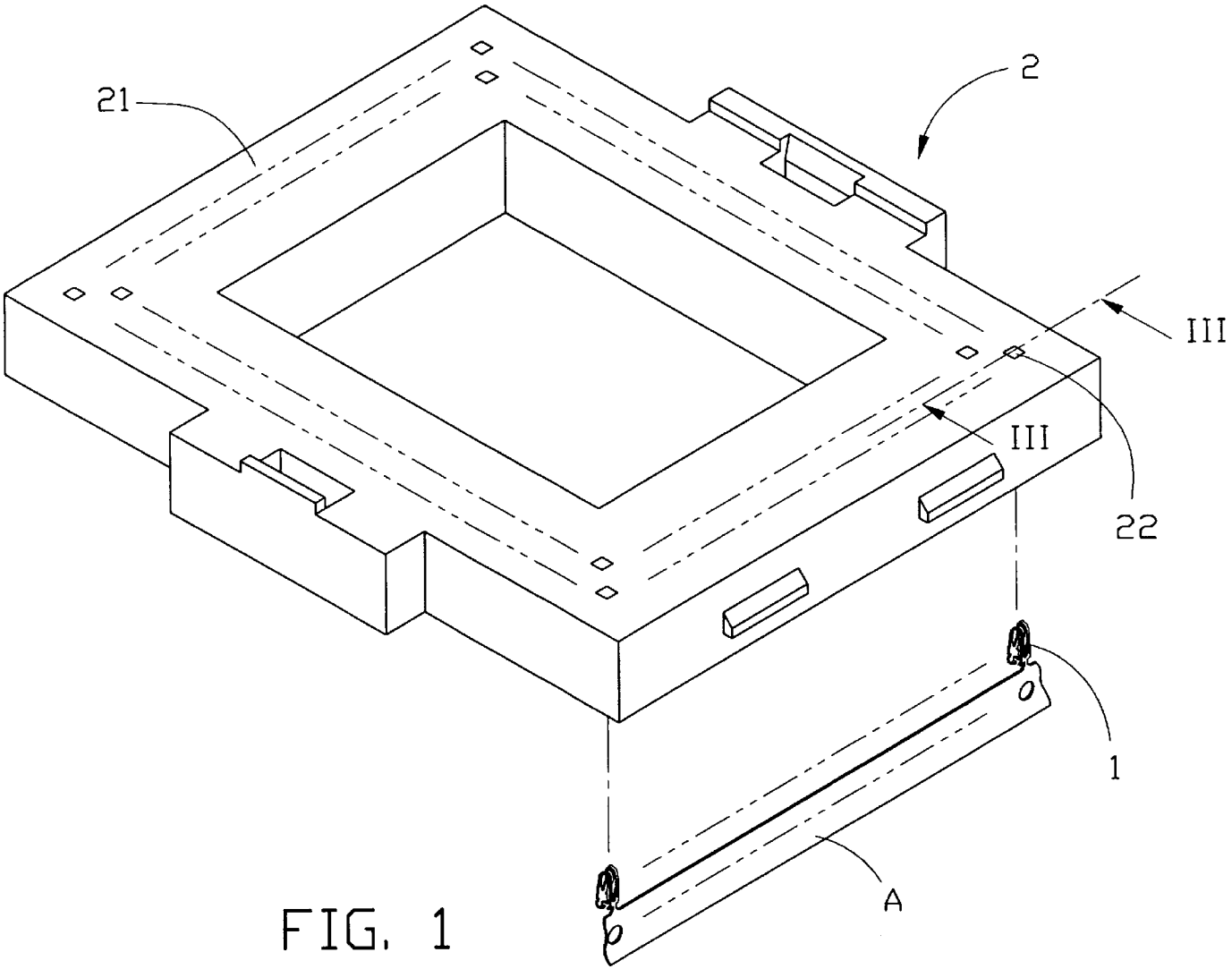
FIG. 1 is an exploded view of a socket in accordance with a preferred embodiment of the present invention.
Figure 2:
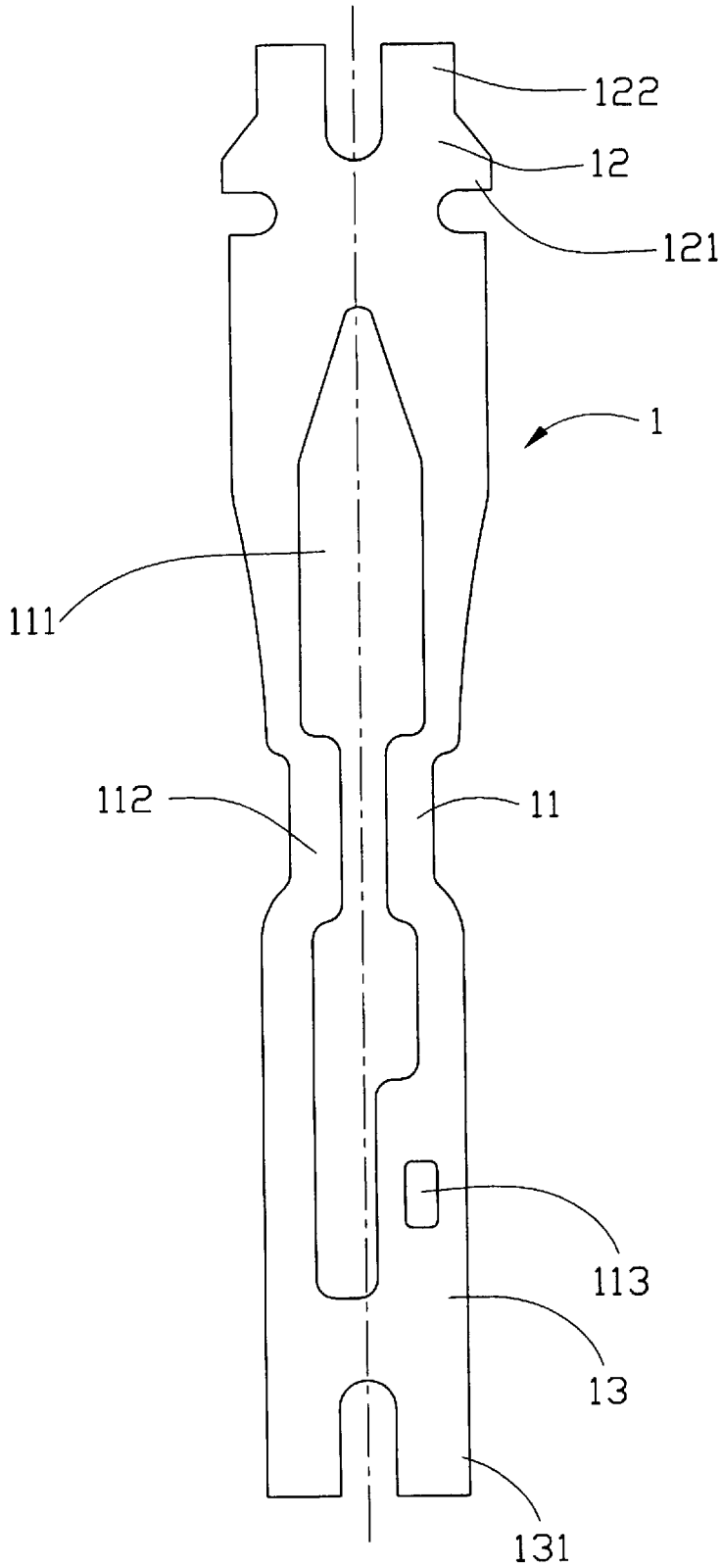
FIG. 2 is a cut-away view of a contact of FIG. 1.
Figure 3:
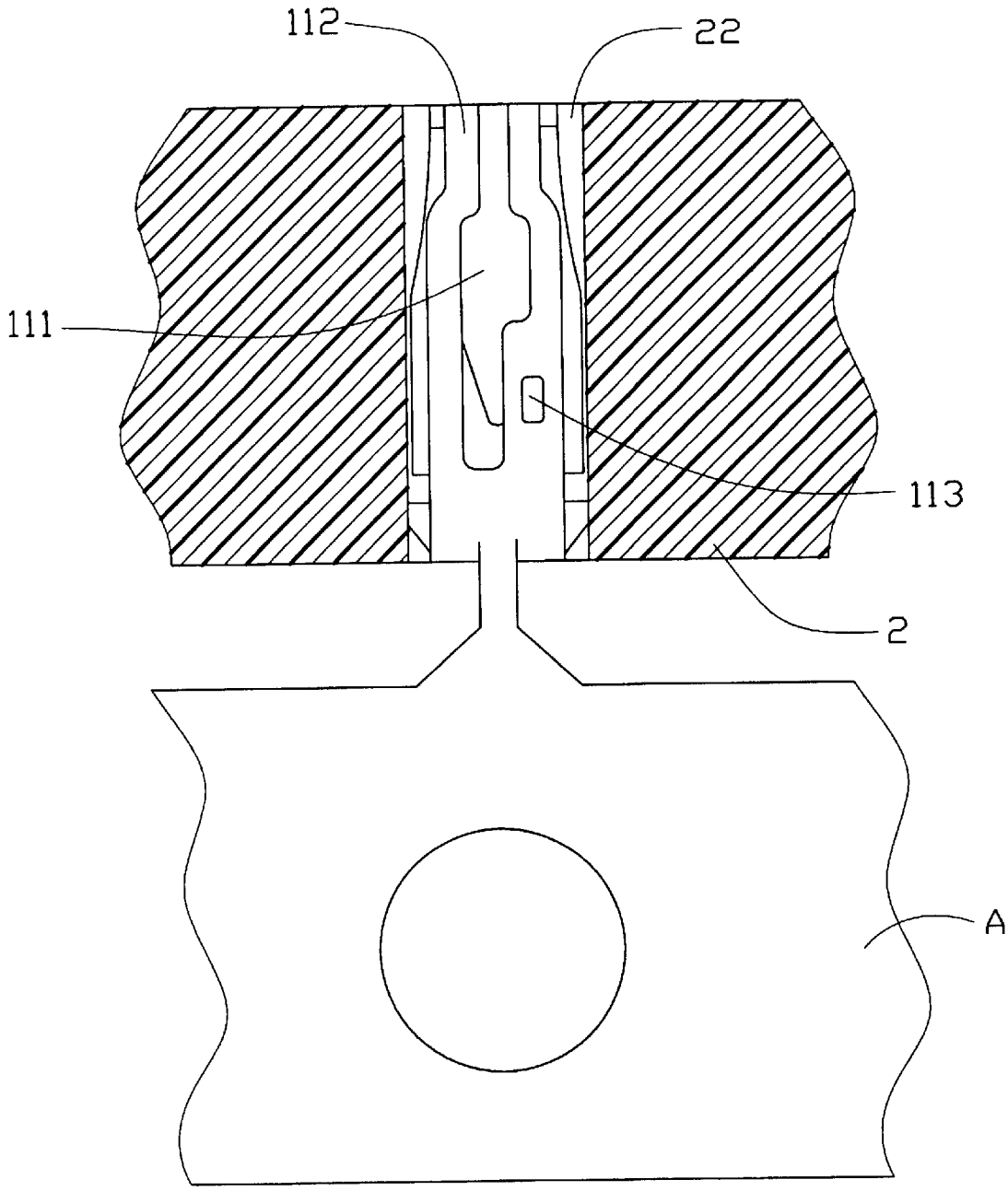
FIG. 3 is a cross-sectional view taken along line III—III of FIG. 1.
Figure 4:
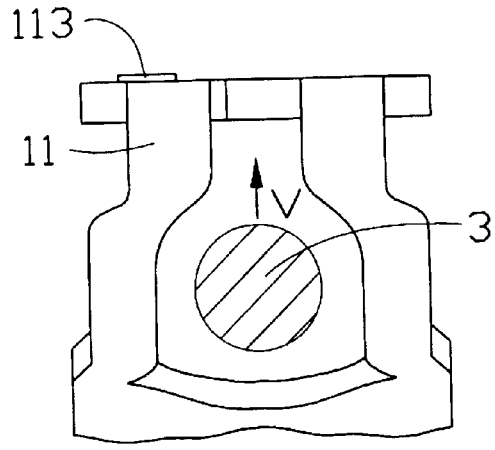
FIG. 4 is a top view of the contact of FIG. 3 showing a pin of a IC package is engaging with the contact.

Reference will now be made to the drawing figures to describe the present invention in detail.

Referring to FIG. 1, a BGA socket 2 in accordance with the present invention includes an insulative housing 21, and a plurality of passages 22 which are formed in the housing 21 and extend between a top surface and a bottom surface of the housing 21 for securing plurality of contacts 1 therein. The contact 1 is stamped from a metal strip A, and can be loaded from the bottom of the insulative housing 21 into the corresponding passage 22.

Referring to FIGS. 2–6, the contact 1 comprises a first ball retention portion 12 and a second ball retention portion 13 which are positioned on opposite ends thereof. A contact portion 11 extends from the first ball retention portion 12 to the second ball retention portion 13. The contact portion 11 has two spring arms 112 which are substantially symmetrical about a center line extending in a longitudinal direction. A pin receiving space 111 is defined for receiving a corresponding pin 3 of a IC package and keeping the pin 3 in the final position.

The first ball retention portion 12 comprises wing portions 121 stamped at opposite edges thereof for skiving into the plastic material of the insulative housing to secure the contacts 1 in the passages 22. The first ball retention portion 12 further comprises a first claw foot 122 extending from the wing portions 121 for skiving into the tin-lead material of a solder ball 4 to keep the solder ball 4 in a predetermined position relatively to the contact 1.

The second ball retention portion 13 comprises a tab portion 113 stamped on one of the spring arms 112 for engaging with the sidewall of the passage 22 to retain the contact 1 in the passage 22 more securely and firmly. The second ball retention portion 13 further comprises a second claw foot 131 which can cooperate with the first claw foot 122 to hold the solder ball 4 firmly and accurately.

Figure 5:
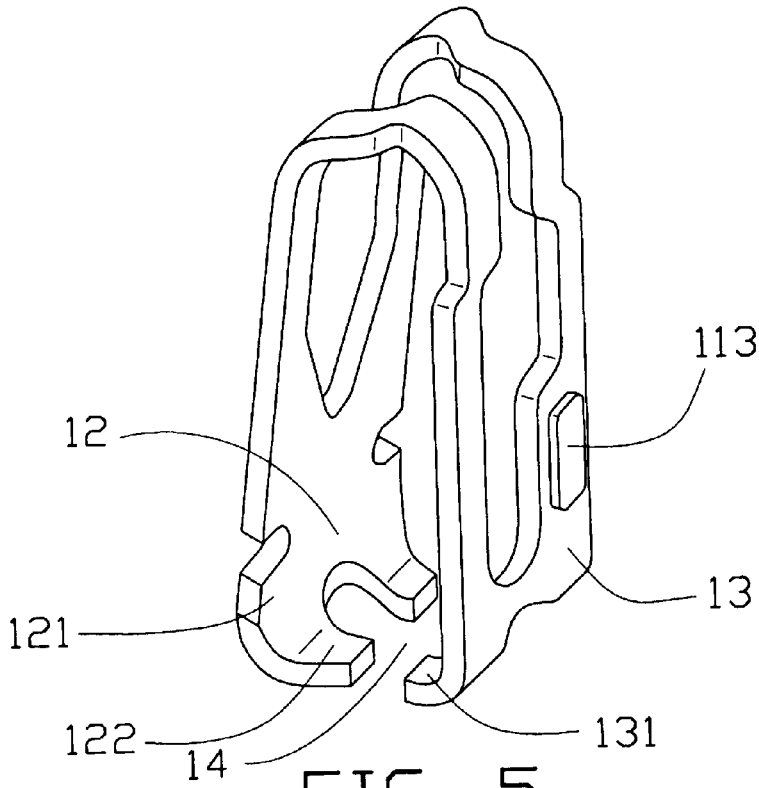
FIG. 5 is a perspective view of the contact of FIG. 1.
Figure 6:
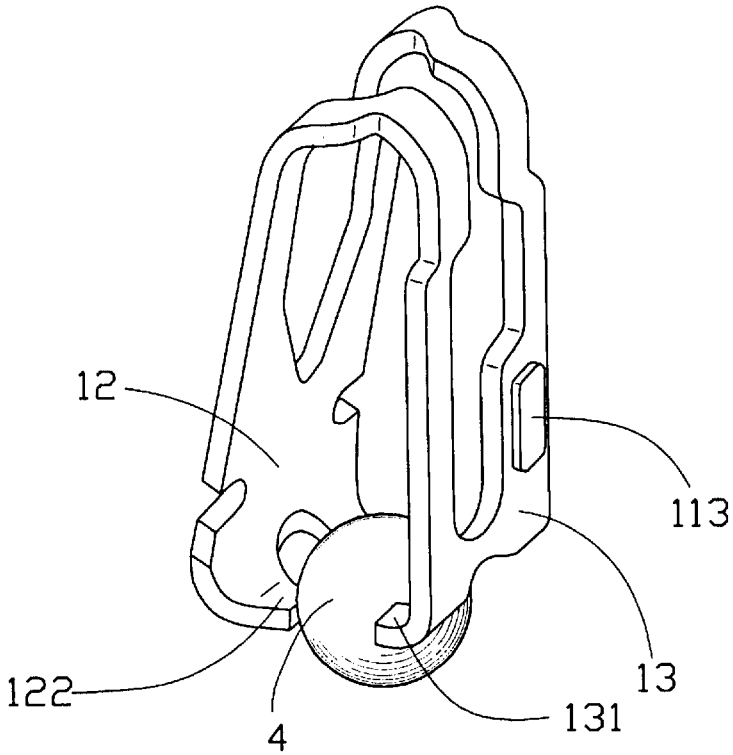
FIG. 6 is a perspective view of the contact of FIG. 5 showing a solder ball is engaged with the contact.
Figure 7:
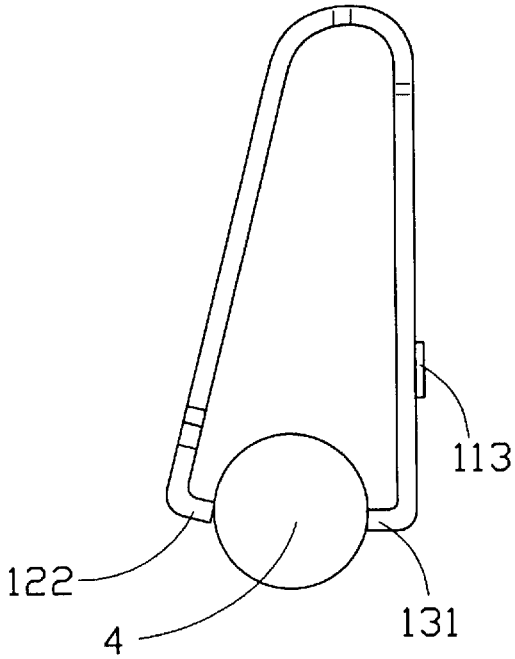
FIG. 7 is a side view of FIG. 6.

Referring particularly to FIGS. 5–7, a clip section 14 is defined between the first and second claw feet 122, 131. The clip section 14 is formed as a small one compared to the solder ball 4 initially. During the solder ball 4 insertion course, the solder ball 4 is engaged with the end of the first and second claw feet 122, 131, because of the elastic of the spring arms 112, and because of the curved surface of the solder ball 4, and there will be a wiping action between the surface of the solder ball 4 and the end of the first and second claw foot 122, 131 along a direction substantially tangential to the curved surface of the solder ball 4, and then the clip section 14 becomes larger and larger until finally the solder ball 4 is kept in the predetermined position. Because the tin-lead material of the solder ball 4 is softer and the metal material of the contact 1 is harder, the first and second claw feet 122, 131 can skive slightly into the solder ball 4, therefore the solder ball 4 will not fall from the clip section 14 when the solder ball 4 is under an unpredictable shocking or an undesired force.

Figure 8:
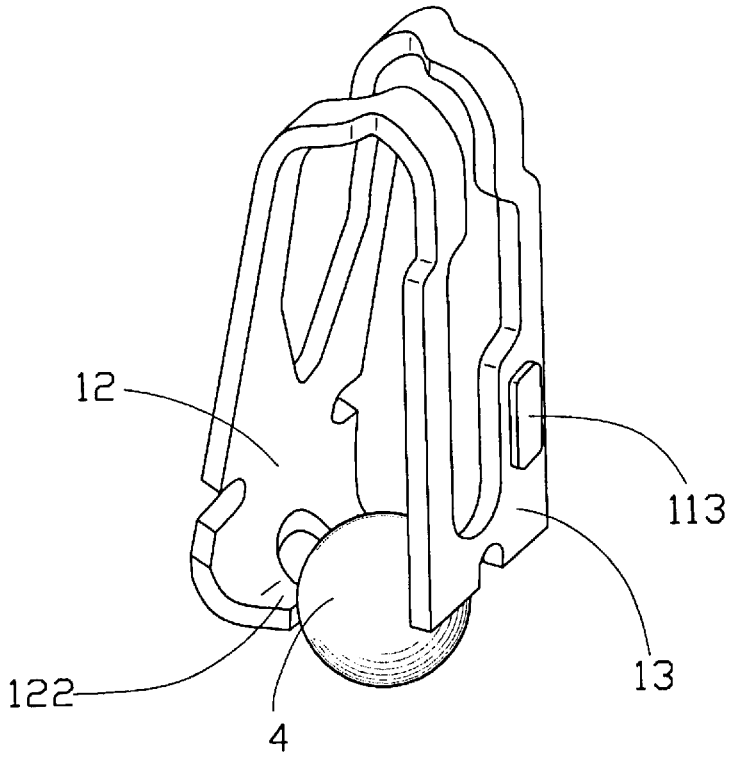
FIG. 8 is a perspective view of a contact in accordance with the another embodiment of the present invention showing a solder ball is engaged with the contact.
Figure 9:
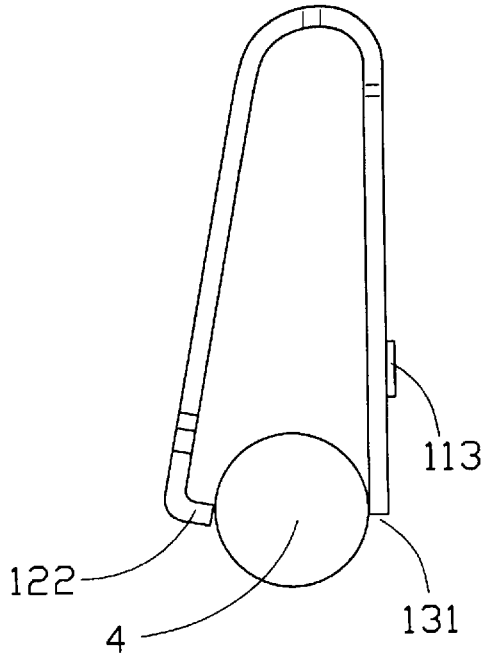
FIG. 9 is a side view of FIG. 8.
Figure 10:
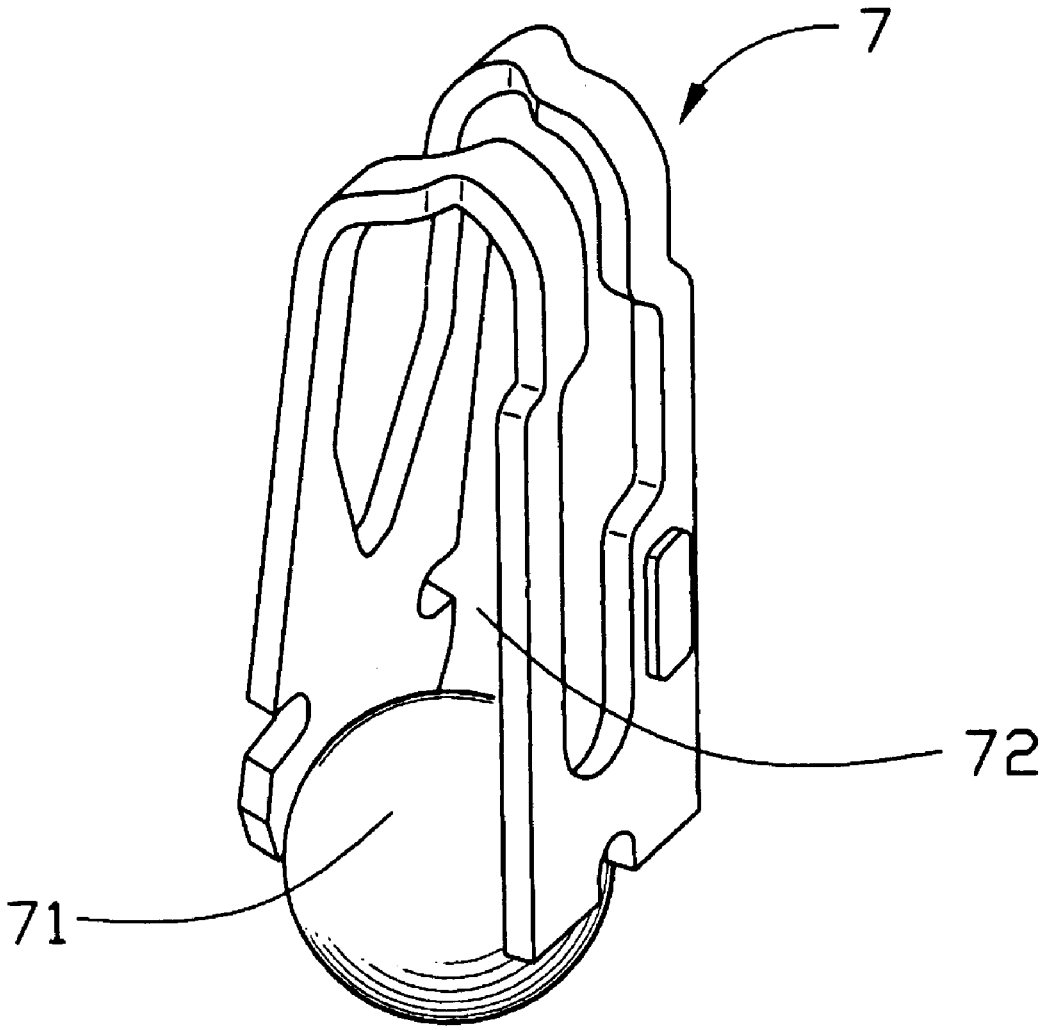
FIG. 10 (PRIOR ART)
FIG. 10 is an cross-sectional view of a conventional socket.

FIGS. 8 and 9 show a contact 1' for a BGA socket (not shown) in accordance with another embodiment of the present invention. The contact 1' is substantially identically configured, except for the configuration of the second ball retention portion 13'. A flat portion 131' is formed on the second ball retention portion 13' instead of the second claw foot 131 and, together with the first claw foot 122, the flat portion 131' can hold the solder ball 4 tightly in the clip section 14.

What is claimed is:

1. A contact received in an electrical socket for interconnecting an integrated circuit (IC) package with a printed circuit board (PCB), comprising:

a contact portion for engaging with a pin of the IC package;

a first ball retention portion formed on one end of the contact portion and having a first ball clip means for engaging with a solder ball; and a second ball retention portion formed on another end of the contact portion and having a second ball clip means for engaging with the solder ball, at least one clip means extending substantially towards the other clip means, and a clip section defined between the first clip means and second clip means;

when the solder ball is engaged with the first and second clip means, the distance of the clip section changed in accordance with the size of the solder ball, whereby the solder ball is securely kept in the clip section by the first and the second clip means, wherein the at least one clip means, formed as a claw foot, is substantially perpendicular to contact surface of the solder ball.

2. The contact as described in claim 1, wherein the first ball retention portion forms a pair of wings on lateral sides thereof for being skived in a housing of the socket.

3. The contact as described in claim 2, wherein the second ball retention portion forms a tab portion for engaging with the housing of the socket.

4. The contact as described in claim 3, wherein the contact portion defines a pair of spaced apart spring arms whereby the pin of the package can electrically contact with the spring arms.

5. The contact as described in claim 1, wherein said first ball clip means and said second ball clip means are claw feet respectively formed at bottom ends of the first ball retention portion and the second ball retention portion, and horizontally extending toward each other.

6. A contact received in an electrical socket for interconnecting an integrated circuit (IC) package with a printed circuit board (PCB), comprising:

a contact portion for engaging with a pin of the IC package;

a first ball retention portion formed on one end of the contact portion and having a first ball clip means for engaging with a solder ball; and a second ball retention portion formed on another end of the contact portion and having a second ball clip means for engaging with the solder ball, at least one clip means extending substantially towards the other clip means, and a clip section defined between the first clip means and second clip means;

when the solder ball is engaged with the first and second clip means, one of the clip means yields outwardly and a wiping action is generated between the first and the second clip means and a curved surface of the solder ball along a direction substantially tangential to the curved surface of the solder ball, the wiping action being stopped when the solder ball is located at a predetermined position;

wherein the at least one clip means, formed as a claw foot, is substantially perpendicular to contact surface of the solder ball.

* * * * *